United States Patent [19]

Tanaka

[11] 4,353,635

[45] Oct. 12, 1982

[54] APPARATUS FOR AUTOMATICALLY DEVELOPING FILM

[76] Inventor: Hiroshi Tanaka, No. 1029, Asahi-Coop, 13-10, 5-chome, Takadono, Asahi-ku, Osaka-shi, Japan

[21] Appl. No.: 269,657

[22] Filed: Jun. 2, 1981

[30] Foreign Application Priority Data

Jun. 14, 1980 [JP] Japan ..... 55/80759
Jun. 18, 1980 [JP] Japan ..... 55/85928[U]

[51] Int. Cl.[3] ..... G03D 3/08
[52] U.S. Cl. ..... 354/320; 134/64 P
[58] Field of Search ..... 354/319, 320, 321, 322, 354/331; 134/64 P, 122 P

[56] References Cited

U.S. PATENT DOCUMENTS

| | | | |
|---|---|---|---|
| 3,532,048 | 10/1970 | Hope et al. | 354/320 |
| 4,181,421 | 1/1980 | Kitrosser | 354/321 |
| 4,255,039 | 3/1981 | Hope et al. | 354/320 |
| 4,291,969 | 9/1981 | Raymond | 354/322 |

*Primary Examiner*—L. T. Hix
*Assistant Examiner*—Alan Mathews
*Attorney, Agent, or Firm*—Wenderoth, Lind & Ponack

[57] ABSTRACT

A bath container and a main body case having the container therein are joined together at a level higher than the liquid level within the container, with spaces formed between the container and the main body case for accommodating a power transmission assembly and providing a duct for passing hot air therethrough. A rack frame supporting many pairs of feed rollers and detachably installed in the container has eave-like shield pieces serving as safety covers and light blocking plates.

2 Claims, 3 Drawing Figures

APPARATUS FOR AUTOMATICALLY DEVELOPING FILM

BACKGROUND OF THE INVENTION

The present invention relates to an automatic film developing apparatus by which an exposed photographic film, especially X-ray film, can be developed, fixed, washed with water and dried full automatically in a continuous operation. Such an automatic film developing apparatus includes a bath container having a large number of film feed rollers disposed therein. Since there is the need to provide a blower, a coupling mechanism and a motor for driving the rollers, etc., the container is usually housed in a main body case with a space formed therebetween for accommodating the required components. Furthermore special care must be taken to prevent leaks of the developer solution, fixing solution and washing water contained in the container and also to preclude the malfunction of the electric system which is likely to be exposed to water vapor. It is also necessary to provide some safety means for avoiding the possible hazard that would result if the gears and chain for power transmission are left exposed within the reach of the user's hand.

SUMMARY OF THE INVENTION

An object of the present invention is to provide an apparatus comprising a main body case and a bath container which are integrally joined together at a level higher than the liquid level in the container, with spaces formed around, and completely isolated from, the bath container within the main body case to perfectly prevent the leakage of the bath.

Another object of the invention is to provide an apparatus of the type described in which the spaces between the bath container and the main body case are utilized for accommodating a power transmission assembly and as a duct for passing hot air and which includes safety means for protecting the switch, motor, etc. from the water vapor released from the bath to prevent malfunctioning, the apparatus thus being made durable and inexpensive to manufacture.

Still another object of the invention is to provide an apparatus of the foregoing type including a rack frame which supports a multiplicity of feed rollers as a unit and which is mountable and removable easily and quickly, the rack frame being formed with eave-like shield pieces serving as safety covers for power transmission gears, etc. and also as light blocking plates.

DETAILED DESCRIPTION OF THE INVENTION

Figure 1:
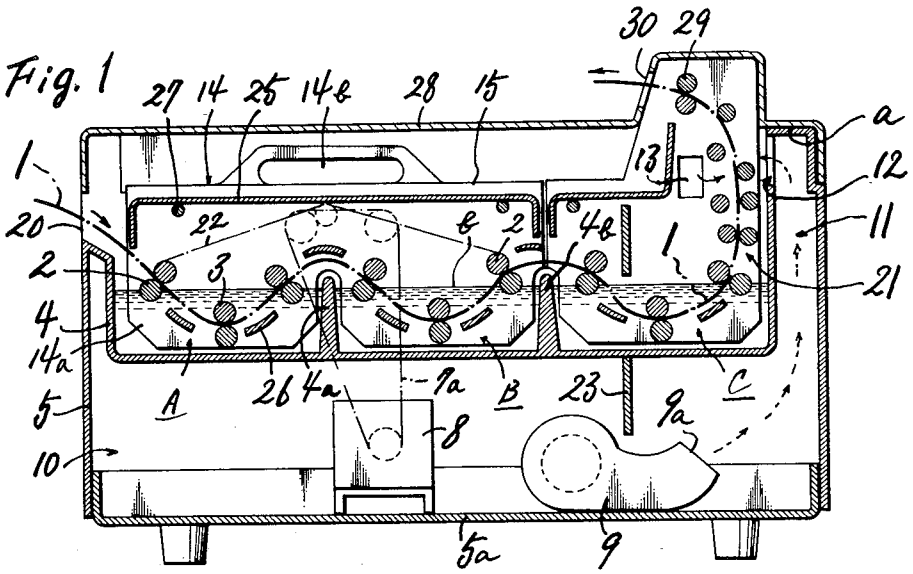
FIG. 1 is a side elevation in vertical section showing an automatic film developing apparatus according to the present invention.
Figure 3:
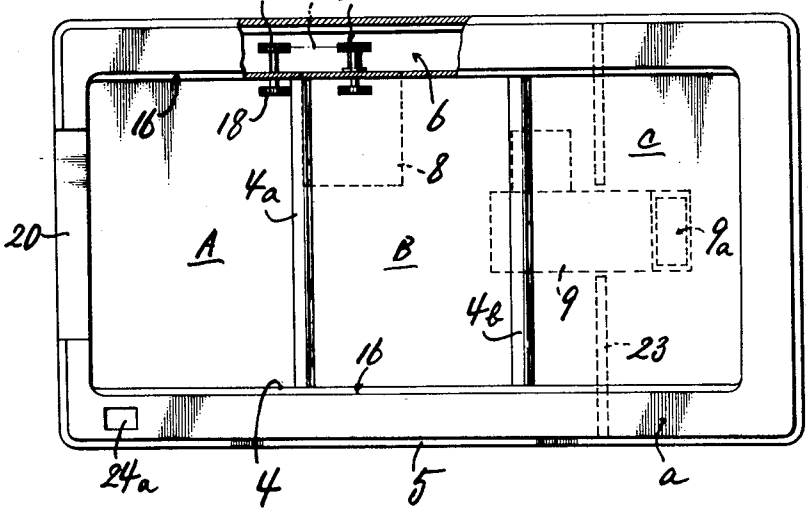
FIG. 3 is a plan view showing the same with a rack frame removed.

With reference to FIG. 1, the strip of film 1 to be developed is placed at its leading end into a bath container 4 and passed through a bath within the container 4 while being guided by feed rollers 2 and guide rollers 3. The container 4 is molded integrally with a main body case 5 holding the container 4 in its interior. Side spaces 6 and a rear space 11 are formed around the container 4 within the main body case 5. The container 4 and the main body case 5 are connected together at their upper ends as indicated at a. The connecting portion a is at a higher level than the liquid level b within the container 4 and closes the spaces 6 and 11 by covering them.

The container 4 is divided by partitions 4*a* and 4*b* into three zones, i.e. a developing zone A, a fixing zone B and a washing zone C. A developer solution, a fixing solution and washing water are respectively accommodated in these zones. A bottom member 5*a* is fitted in the bottom of the main body case 5 to form a space 10 between the bottom member 5*a* and the bottom of the container 4. A drying blower 9 and a motor 8 for driving the feed rollers 2 are accommodated in the bottom space 10. A power transmission assembly 7 for the feed rollers 2 is disposed within one of the side spaces 6.

The rear space 11 formed between the rear portions of the container 4 and the main body case 3 is utilized as a duct for passing hot air therethrough to apply the hot air to the film surfaces through a rear opening 12 and side openings 13 formed in the container 4.

The feed rollers 2, guide rollers 3 and fixed guides 26 arranged within the container 4 are supported as an assembly by a rack frame 14 comprising two opposed side plates 14*a* and 14*a*. When handles 14*b* on the rack frame 14 are grasped by the hands, the whole assembly can be raised or lowered for removal or insertion. Eave-like shield pieces 15 extend outward from the upper ends of the opposite side plates 14*a* of the rack frame 14. The shield pieces 15 are supported by stepped engaging portions 16 in the upper portions of the inner walls of the container 4, whereby the whole assembly is supported.

The upper and lower feed rollers 2 incorporated in the rack frame in pairs are coupled with each other by gears 2*a* and 2*b* and are all adapted to be driven by one input gear 17 which is opposed to a drive gear 18 supported on the container 4. When the rack frame assembly is set in position within the container 4, the input gear 17 on the rack frame 14 spontaneously comes into mesh with the drive gear 18. Further when the rack frame 14 is thus installed in the container 4, the clearances 19 between the inner wall of the container 4 and the side plates 14*a* are closed at their upper portions by the shield pieces 15. Accordingly the gears, etc. provided in the clearances 19 are completely covered with the shield pieces 15 and are out of reach of the operator's hand to assure improved safety. The shield pieces 15, which also serve as light blocking plates, further prevent objectionable rays from entering the clearances 19.

The power transmission assembly 7 comprises a chain 7*a* and gears 7*b* and 7*c*. The terminal gear 7*c* is supported on a shaft 7*d* extending into the container 4 through the side plate thereof. The drive gear 18 meshing with the input gear 17 is mounted on the forward end of the shaft 7*d*.

The input gear 17 is rotatably supported by one of the side plates 14*a* of the rack frame 14 and is coupled with the feed rollers 2 by a chain 22 and gears 2*c*, 2*d*.

The drying blower 9 is disposed within the bottom space 10 with its air outlet 9*a* inclined rearwardly upward to discharge hot air at a location to the rear of a partition plate 23. The hot air flows as indicated by the dotted-line arrows in FIG. 1 into the rear space 11 and side spaces 6, from which the air flows out at the same time through the rear opening 12 and side openings 13 and comes into contact with the opposite surfaces of the film.

A power supply switch 24 for the motor 8 and the drying blower 9 is mounted on the connecting portion a at the upper ends of the container 4 and the main body case 5. The switch 24 has a main body fixedly provided inside the connecting portion a and an operating portion 24*a* projecting upward through the connecting portion a. Although the inside of the connecting portion a is in communication with the spaces 6 and 11, these spaces are completely separated from the interior of the container 4 and are therefore free from the water vapor released from the bath, so that there is no likelihood that the switch 24 will be adversely affected.

Figure 2:
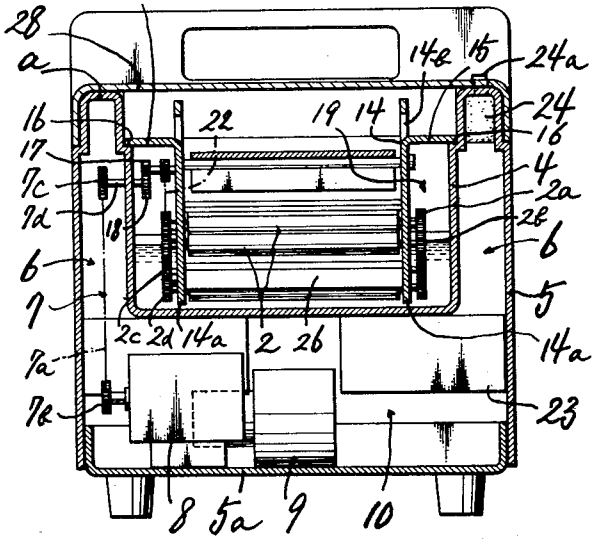
FIG. 2 is a front view in vertical section showing the same.

FIGS. 1 and 2 further show a closure plate 25 removably supported by rods 27 for covering the rack frame 14 from above, and a cover 28 for the main body case 5.

When the film 1 to be developed is placed into a front inlet 20 and fed to the first pair of feed rollers 2, the film is further sent forward and passed through the developing zone A, then through the fixing zone B and thereafter through the washing zone C in a zigzag manner so as to be successively immersed in the baths. In a drying zone 21, the front and rear surfaces thereof are exposed to the hot air forced out from the openings 12, 13, and the film is then directed toward an outlet 30 by delivery rollers 29 and finally discharged from the apparatus.

According to the present invention in which the main body case and the container for developing, fixing and other baths are integrally molded and joined together at their upper ends with spaces formed between their vertical side walls, the spaces are free from leaks or water vapor. Moreover, the side space which is completely separated from the interior of the bath container can be utilized for accommodating the power transmission assembly for the feed rollers. The power assembly, which is not exposed, is not accessible and is therefore free of hazards so as to assure safety. The power supply switch will not be subject to the influence of water vapor and is easy to operate since it is disposed on the top of the apparatus. The rear space which can be used for passing hot air eliminates the need for a hot air duct, giving the apparatus a simple construction.

Further according to the invention, which uses a rack frame formed with shield pieces at the upper ends of its side plates, the clearances between the inner wall of the bath container and the frame side plates can be closed completely to prevent the entry of light rays and to cover the gears, etc. provided in the clearances, keeping the gears and other members out of reach of the operator to assure improved safety. With the shield pieces serving also as engaging members, the whole rack frame assembly can be supported in suspension in the specified position without necessitating any special engaging means.

What is claimed is:

1. An apparatus for automatically developing a film by passing the film through a bath, said apparatus comprising:

a container for the bath having upwardly extending side and end walls;

a main body within which said container is positioned, said main body having upwardly extending side and end walls spaced from the side and end walls of said container to define spaces therebetween, the upper ends of said side and end walls being integrally joined together to close the upper end of said spaces; said container having a bottom positioned above the bottom of said side and end walls of said main body to define a bottom space thereunder and which is joined to said space between said side and end walls;

a feed roller assembly removably mounted in said container;

a power transmission assembly in one of said spaces and detachably connected to said feed roller assembly;

a drive motor in one of said spaces connected to said power transmission assembly for driving said power transmission assembly;

said container end wall and side walls having openings therein at the delivery end of said feed roller assembly and opening out of the upper ends of the spaces between said side walls and end walls; and a drying blower in one of said spaces and having a hot air discharge directed toward said spaces between said container and main body side and end walls for directing hot air upwardly therethrough and out of said openings for drying film being discharged by said feed roller assembly.

2. An apparatus as claimed in claim 1 in which said feed roller assembly includes a frame having upwardly extending side plates, the rollers of said assembly being mounted across the space between said side plates, and laterally extending shield pieces on the upper edges of said side plates, and said side walls of said container having step portions therein on which the outer ends of said shield pieces rest for supporting said feed roller assembly in said container, said shield pieces covering the upper ends of the spaces between said side plates and the side walls of said container.

* * * * *